United States Patent [19]

Bierscheid, Jr.

[11] Patent Number: 4,899,832

[45] Date of Patent: Feb. 13, 1990

[54] MODULAR WELL DRILLING APPARATUS AND METHODS

[76] Inventor: Robert C. Bierscheid, Jr., 11735 Zarroll, Houston, Tex. 77099

[21] Appl. No.: 133,246

[22] Filed: Dec. 10, 1987

Related U.S. Application Data

[63] Continuation of Ser. No. 766,486, Aug. 19, 1985, abandoned.

[51] Int. Cl.[4] ..... E21B 7/02

[52] U.S. Cl. ..... 173/23; 173/28; 173/22; 173/163; 175/85

[58] Field of Search ..... 173/22, 28, 163, 164, 173/23; 175/24, 52, 85; 166/77.5, 78

[56] References Cited

U.S. PATENT DOCUMENTS

| | | | |
|---|---|---|---|
| 3,280,920 | 10/1966 | Scott | 173/164 |
| 3,499,498 | 3/1970 | Bromell et al. | 175/52 |
| 3,650,339 | 3/1972 | Selfe et al. | 175/85 |
| 4,106,575 | 8/1978 | Bunnelle | 173/164 X |
| 4,258,796 | 3/1981 | Horning et al. | 173/164 |

*Primary Examiner*—Douglas D. Watts
*Assistant Examiner*—Willmon Fridie, Jr.
*Attorney, Agent, or Firm*—Dodge, Bush & Moseley

[57] ABSTRACT

A highly automated well drilling apparatus that is transportable in modular units to a well site where the units are rapidly assembled into an integrated operational assembly. The apparatus includes a drilling unit and two raising units that are locked to the respective opposite sides thereof. After base structures on the raising units are lowered to the ground to provide a support, the towers of the raising units and the mast of the drilling unit are simultaneously elevated to the vertical. The same raising units then are employed to erect pipe supply frames that are connected to the front of each tower. The drilling unit includes a top rotary drive, an automated power tong, and a pipe handling system that are remotely operated from a control center. Power supply, mud return, mud supply and mud pump units also are located in a unique array adjacent the drilling unit to provide an integrated and efficient drilling system.

16 Claims, 6 Drawing Sheets

57
56
57
51
55
52
50
53
54
31
32
30
35
36
47
46
45
48
38
33
37
34
40

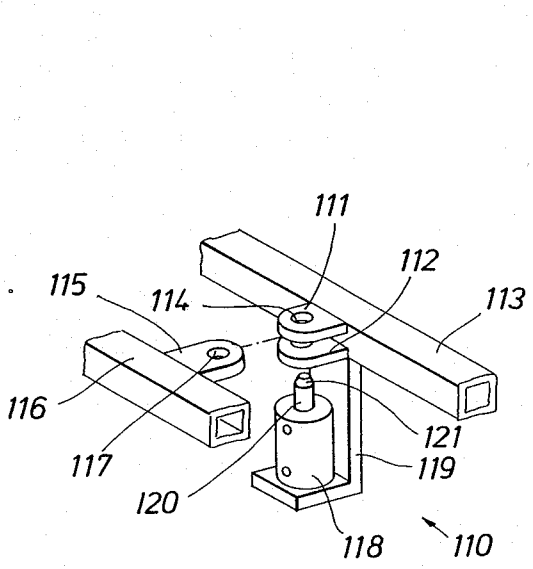
FIG. 7
FIG. 6
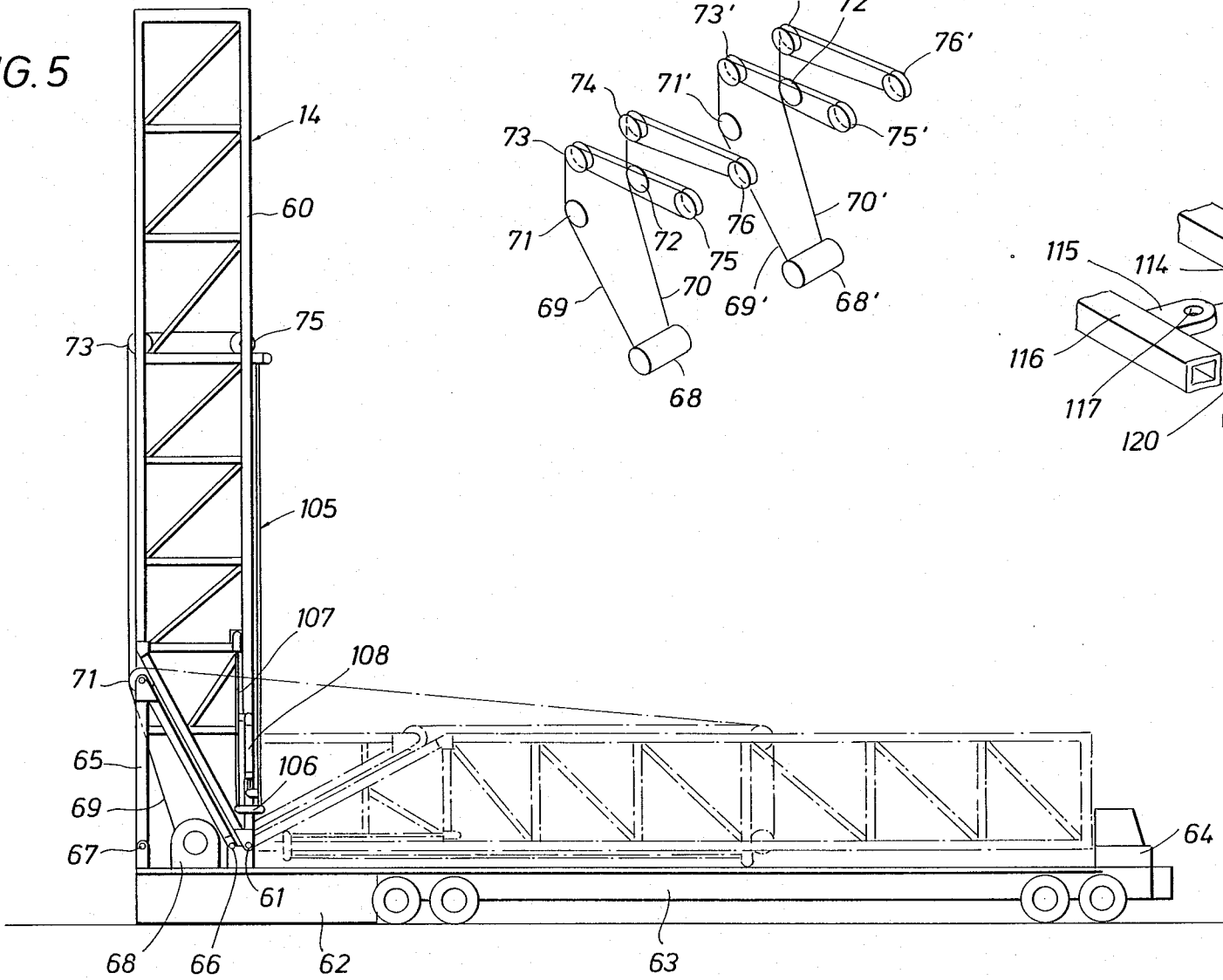
FIG. 5

FIG. 8
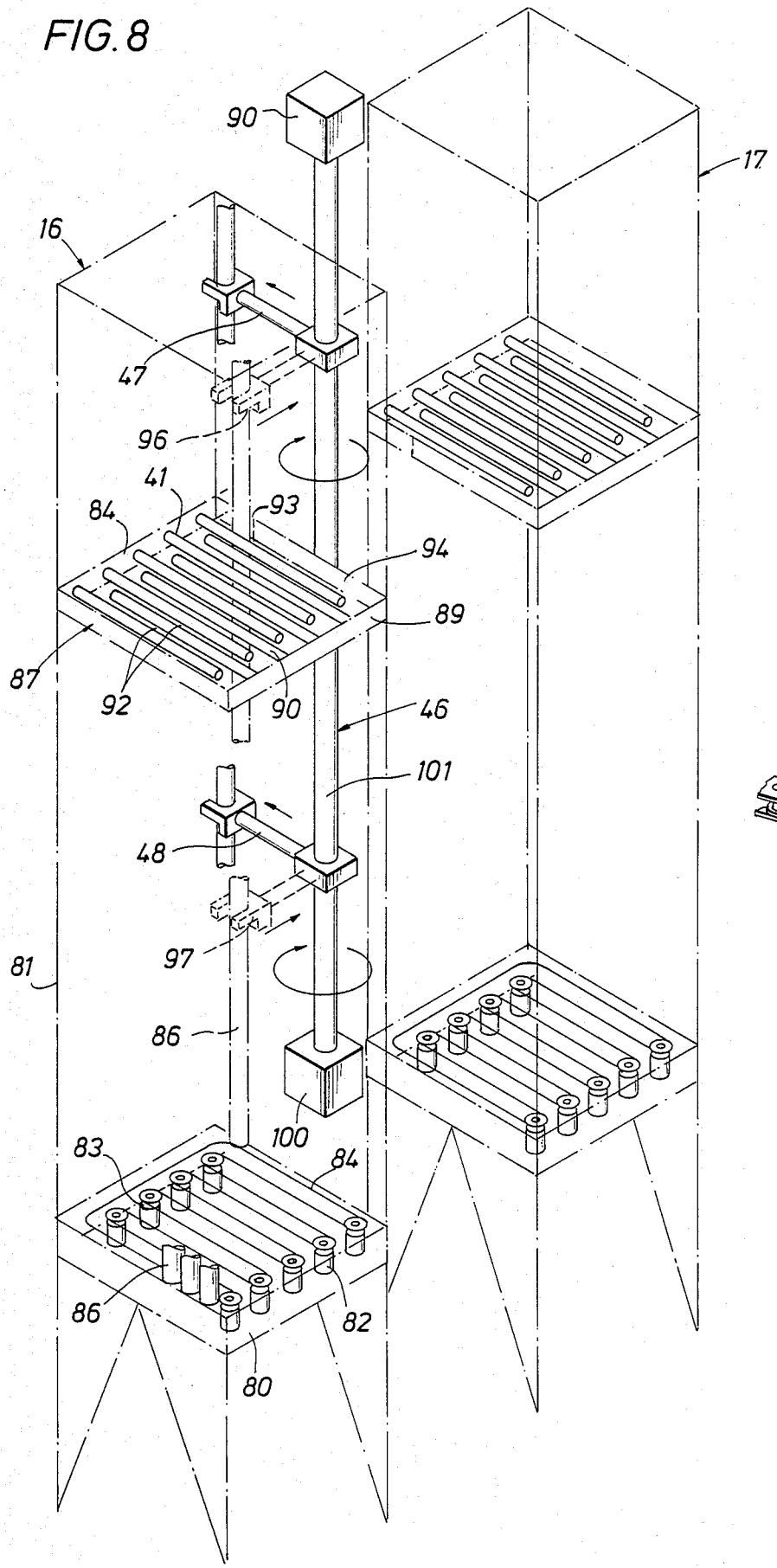
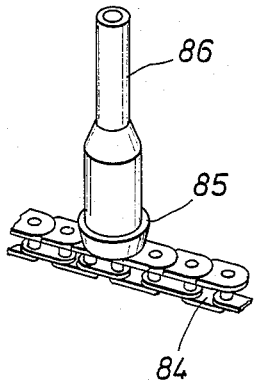
FIG. 9

MODULAR WELL DRILLING APPARATUS AND METHODS

This application is a continuation of application Ser. No. 766,486, filed Aug. 19, 1985.

FIELD OF THE INVENTION

The present invention relates generally to earth boring or well drilling methods and apparatus and particularly to new and improved modular or unitized earth boring systems and processes employing highly unique erection, operation and transportation techniques.

BACKGROUND OF THE INVENTION

The development of well drilling rig equipment and procedures for the past 30 or so years has shown slow progress, to the point that most rigs designs have remained relatively unchanged. This industry is well known for its "inertia" and reluctance to accept innovative change, even though various attempts have been made to achieve greater efficiency, self-containment and automation of well drilling equipment. For example, a multi-section, pinned, cantilever mast have been developed which allows a rig to be moved to a well site in a partially assembled state. Although erection time was reduced, and transportability enhanced, the remainder of the mechanical and fluid control components of the rig were such that the system has been very time consuming to assemble. It has been necessary to handle numerous pins, bolts, wirelines, hoses and electrical cables, as well as to manually handle the drill pipe during drilling operations.

Attempts to reduce erection time have primarily involved the use of telescoping masts, and masts with self-elevating drill floors. Efforts to simplify drilling operations have involved the development and use of top mounted drive systems and automatic pipe racking systems. In the area of transportation requirements, efforts have been made at reducing load sizes and quantities. Slab masts, as well as some substructures (typically trailers) have been developed to this end. In spite of all such efforts, applicant believes that nowhere in the current market place can a rig be found that combines any significant advancements in all of the aforementioned technological areas.

A general object of the present invention is to provide new and improved well drilling methods and apparatus which combine technological advances in the areas of erection techniques, drilling operations, and transportation.

Another object of the present invention is to provide new and improved methods and apparatus for transporting a unitized or modular drilling rig to the well site and erecting the same in reduced time.

Still another object of the present invention is to provide a drilling rig of the type described having a new and improved automatic pipe handling system that greatly increases productivity by significantly reducing the manpower needed for operating the same.

A further object of the present invention is to provide a new and improved drilling rig that is easy to move and set up, and which is fully automated and self-monitoring.

Another object of the present invention is to provide new and improved drilling rig apparatus and methods which reduce overall drilling and completion costs by limiting the time required to erect and assemble the rig at the well site, and by eliminating where possible the manual handling of consumables.

SUMMARY OF THE INVENTION

These and other objects are attained in accordance with the present invention through the provision of an earth boring apparatus comprising a plurality of transportable modules that can be combined at the well site into a complete and fully automated well drilling system. The system includes a drilling unit that provides a combination base structure/tractor-trailer having mounted thereon the B.0.P. accumulator, electric drawworks, deadline anchor, wireline spool, flowline connections and choke manifold. This unit preferably provides a rigid frame support for the crown sheaves, top drive drilling system, mechanical pipe handler, power slips, master bushing, automatic tensioner, hydraulic locks and "monkey" arm. The standpipe and rotary hose also are attached to this unit.

The system further includes a first raising unit having a self-setting base structure in combination with a detachable tractor. This unit also includes an electrically operated raising winch, a wireline spool, raising arms, a hydraulically operable gin pole, and pipe unit elevator arms. Hydraulically operable means are provided to allow interconnection with other base structures.

A second raising unit also includes a self-setting base structure/trailer with a detachable tractor, an electrical raising winch, wireline spool, arms, gin pole, pipe unit elevator, hydraulic interconnector locks, and also preferably includes cement and mud slurry manifolds.

A pair of electric power supply units each have instrumentation and hydraulic locks mounted on a self-setting sub-base/trailer with tractor.

A plurality of mud units also are provided. One unit has a shale shaker, a desander, a desilter, a choke manifold and a sediment pit, while other units have mixing components and piping. A reserve mud unit may be provided.

A mud pump unit provides yet another module of the combination. This unit has a triplex mud pump and associated pipes, and a bulk mud hopper with an auger-type feed mechanism.

A control unit provides a command center which houses a master computer, communication equipment, video monitors, and living quarters.

Other units include a water unit, a cement unit, a fuel unit with pump, and two pipe units, each of which can store, for example, 60 foot stands of 5 inch o.d. drill pipe. Other numbers of different diameter drill pipe can be stored, depending upon the hole depth and bit diameter. Two casing storage units also are provided, each of which can house 60 foot stands of casing.

In performing methods in accordance with the present invention, the above-mentioned drilling unit is driven into a position of alignment with the centerline of the conductor pipe. The two raising units are then driven into their respective positions on the opposite sides of the drilling unit, whereupon hydraulic locks are activated to interlock the raising units and the drilling unit. The base units of the trailers now can be lowered to the ground by means of a hydraulic suspension, and outriggers set, so that the trailers can be disconnected and driven away. The various other units mentioned above also are driven into position to the rear of the drilling unit and hydraulically locked, with the mud pump, control center, water, cement and fuel units preferably having positioned at right angles to the mud and electrical power supply units. When positioned, all plugs can be engaged and secured, so that each subsystem can be activated and checked out by computer. At this time, the gin poles on the raising units are raised upward and pinned.

In accordance with the performance of further steps of the methods of the inventions, the raising units, each of which includes a self-contained wire rope raising apparatus, are simultaneously erected, thereby raising the drilling unit to the vertical. After these structures have been hydraulically locked in the drilling position, the forward trailer sections of both raising units are disengaged and driven away to a staging area, so as to leave the raising units clear to receive the pipe storage units. Now the pipe storage units are backed up into position and hydraulically locked, and the raising arms are pivoted downward and locked to the horizontal pipe storage units. The storage units now are raised to vertical, using the same wire rope system which was used previously to erect the raising units. The entire drilling system of the present invention is then operational and ready to begin the drilling of a borehole.

BRIEF DESCRIPTION OF THE DRAWINGS

The present invention has other objects, features and advantages which will become more clearly apparent in connection with the following detailed description of a preferred embodiment, taken in conjunction with the appended drawings in which.

FIG. 5 is a side elevational view of a raising unit in accordance with the present invention, the transport position being shown in dotted lines and the erect position being shown in solid lines;

FIG. 6 is a perspective schematic view of the winch, sheave and wire rope system employed in the raising unit of FIG. 5;

FIG. 7 is an isometric, fragmentary view of a hydraulically operable coupler that can be used to interlock various units of the present invention to one another;

FIG. 8 is a perspective somewhat schematic view of the pipe storage and handling units;

FIG. 9 is a fragmentary view of a portion of the pipe conveyor chain; and

DETAILED DESCRIPTION OF A PREFERRED EMBODIMENT

Figure 1:
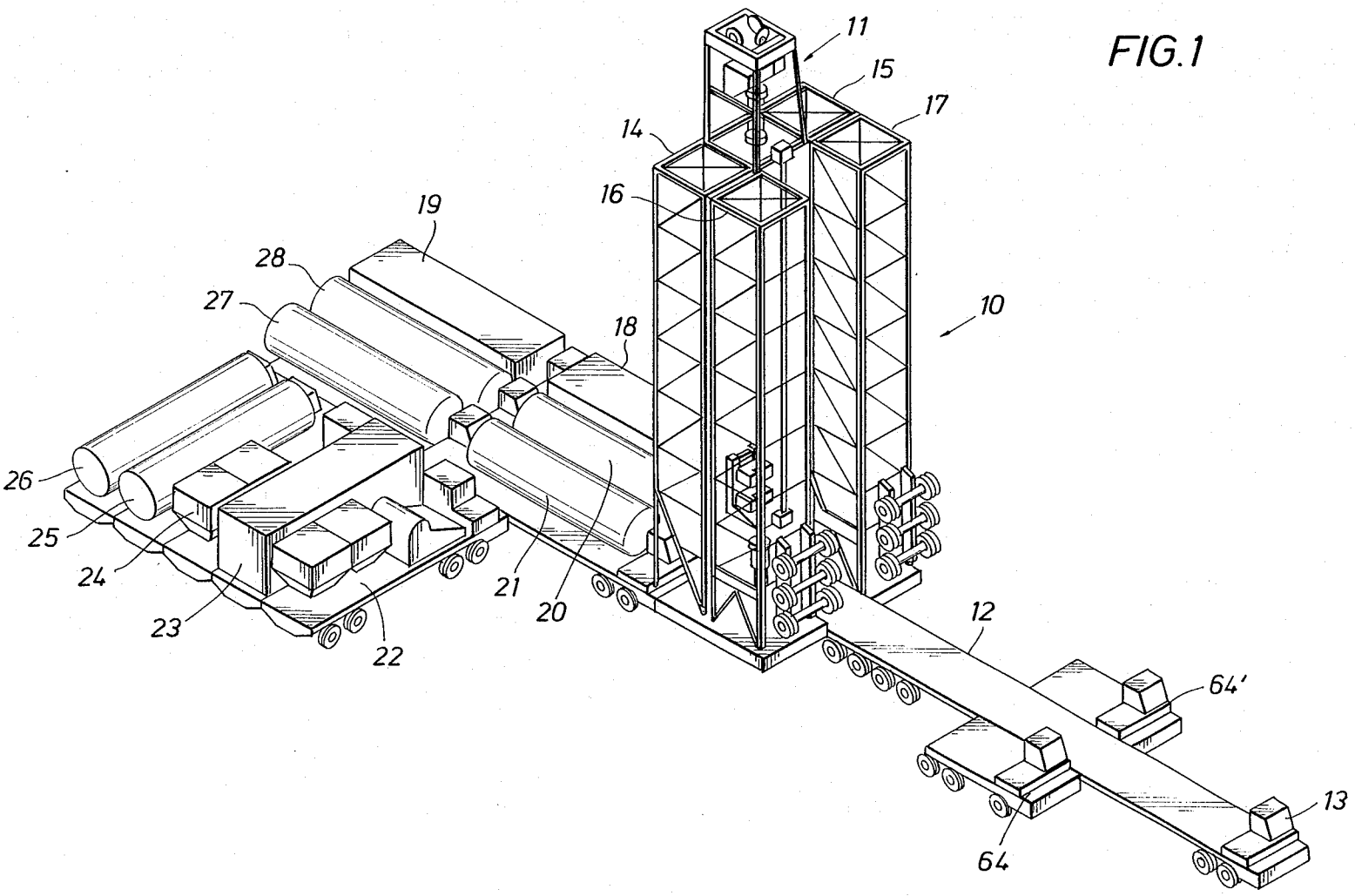
FIG. 1 is a perspective view of the drilling apparatus of the present invention with the various modules or located in a preferred manner with respect to one another for performing a well drilling operation.
Figure 2:
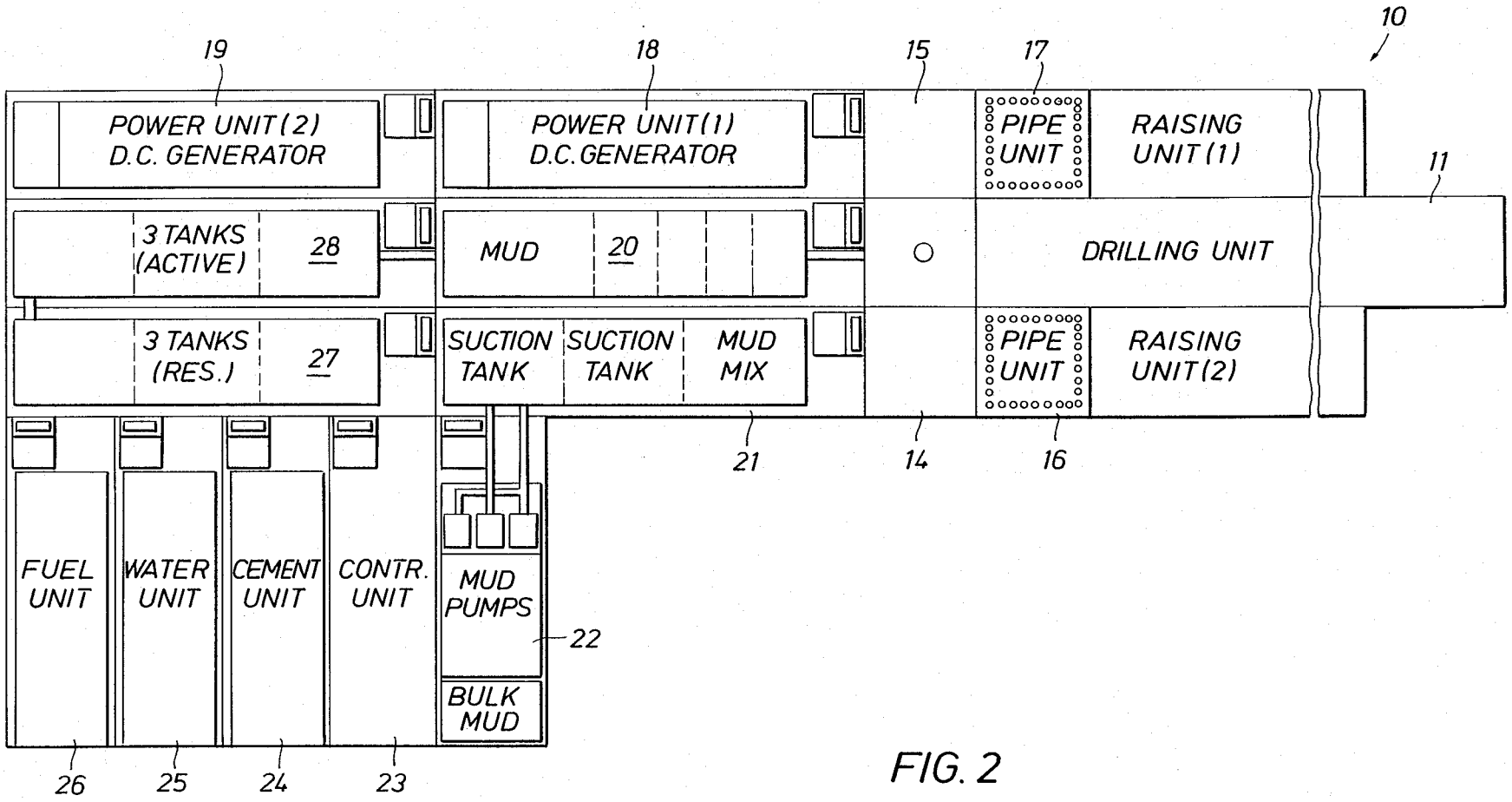
FIG. 2 is a top plan view of the drilling apparatus of FIG. 1.

Referring initially to FIGS. 1 and 2, a drilling apparatus 10, constructed and arranged in accordance with the principles of the present invention is illustrated in the erect condition at a well site. The assembly 10 is comprised of a number of discrete units, or modules, which will be described generally and specifically herebelow. In many instances a particular module has included therein a combination of well known apparatus and equipment components which have constructional details that will be fully apparent to those skilled in the art, so as not to require an elaborate description in this application. In general, the present invention comprises the combination of a drilling unit 11 that is transported to the well site on a trailer 12 having a tractor 13. On opposite sides of the drilling unit 11 are raising units 14 and 15 that have been previously raised to the vertical as shown in FIG. 1, and pipe storage units 16 and 17 which store the numerous stands of drill pipe or casing used in the well drilling operation. A first electrical power supply unit 18 that is mounted on a truck is driven to a position immediately to the rear of the raising unit 15, and a second electrical power supply unit 19, also truck-mounted, is parked immediately to the rear of the unit 18. To the side of the power supply unit 18 is a drilling mud return unit 20 including a shale shaker, a desander, a desilter, a degasser and a sediment tank or pit. This unit also is truck-mounted and provided complete with hydraulic locks and plug boards. A mud mixing and supply unit 21 is located alongside the mud return unit 20, and a mud pump unit 22 is stationed toward the rear of the unit 21, and preferably at a right angle thereto. Located alongside the unit 22 are a command center 23, a cement unit 24, a water supply unit 25 and a fuel unit 26. Immediately in front of the units 23–26 is a reserve mud unit 27, and between the unit 27 and the unit 19 is parked a back-up mud supply unit 28. Each of the aforementioned units is trailer-mounted, and tractor-pulled, so as to be totally portable. Each unit also is provided with a hydraulic lock assembly that is activated as the units are positioned as shown to provide a rigid and, in effect, integral system of individual components. Various ones of the units may also have a self-setting sub-base under hydraulic control so that the truck bed may be leveled and locked vertically.

Figures 3, 4:
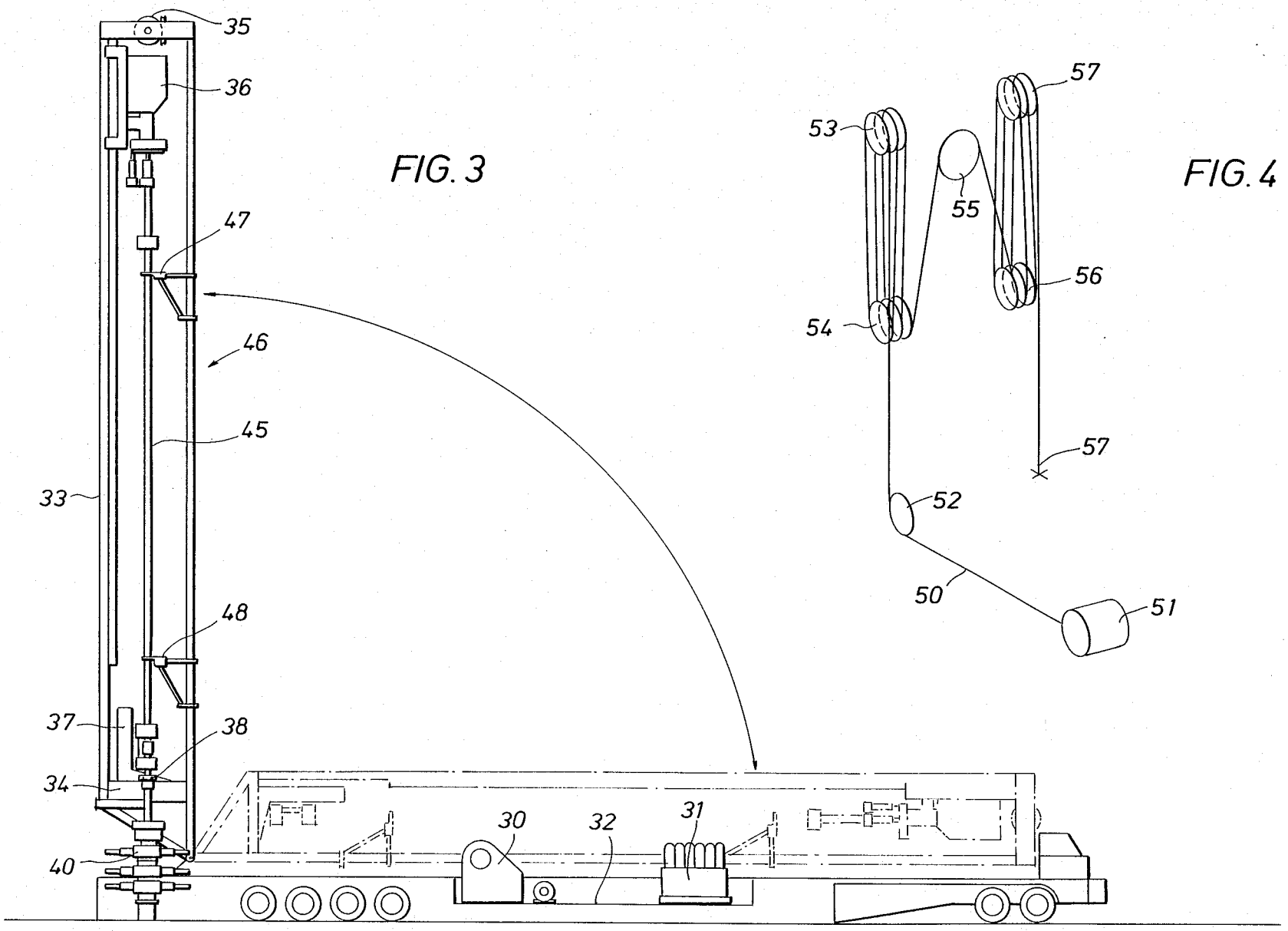
FIG. 3 is a side view of the drilling unit of the present invention with the mast shown in phantom lines as transported, and in solid lines as erected.
FIG. 4 is a perspective schematic view of the drawworks, sheave and cable arrangement incorporated in the drilling unit.

Referring now to FIG. 3, the drilling unit 11 includes a drawworks 30 and a blowout preventer accumulator 31 that are mounted on a base structure 32 that also provides the trailer. The unit includes a pivotally mounted mast structure 33 having a drilling platform 34 at its lower end and crown sheaves 35 at its upper end. A drill pipe drive apparatus 36, commonly known as a Varco Top Drive System, is slidably mounted in the upper section of the mast 33, and a power tong apparatus 37 for threading, with reading and torquing pipe connections is fixed to the platform 34. The apparatus 37 also is commercially available from VARCO, and is identified in the trade by the mark "iron roughneck." A rotary bushing 38 that carries powered pipe slips also is mounted in the platform 34, and a standpipe 39 and rotary hose are suitably attached to the mast 33. A typical blowout preventer stack 40 can be mounted at the rear of the trailer bed 32 through use of suitable mounts.

A stand of drill pipe 45 is shown suspended in the mast 33 from the drive unit 36. The pipe 45 is positioned in alignment with the bushing 38 by an automatic pipe handling system indicated generally at 46 having upper and lower remote controlled arms 47 and 48 mounted on a vertical shaft. The pipe handling system 46 is substantially similar to equipment offered by B. J.-Hughes under the mark "monkey ar." The vertical position of the drive unit 36 is controlled by a system of sheaves and a cable shown schematically in FIG. 4. The cable 50 extends from the winch 51 of the drawworks 30 around a lower fixed sheave 52 to an upper assembly of fixed sheaves 53. From the sheaves 53 the cable extends to support sheaves 54 on one side of the drive unit 36, then upward to a fixed center sheave 55, then downward to another set of support sheaves 56 on the opposite side of the drive unit, and then upward again to another assembly of fixed sheaves 57 on the mast 33. The outer end of the cable 50 extends downward to where it is anchored at a dead-man point 57. Thus the cable 50 can be paid out by the winch 51 in order to lower the drive unit 36 relatively along the mast 33, and taken in order to raise the same.

As previously mentioned, the raising units 14 and 15 are located on the respective opposite sides of the mast 11. These units are essentially identical, and the driller's side unit 14 is shown in FIG. 5. The unit 14 includes a generally rectangular frame 60 that is pivoted on pins 61 at its lower end to a base structure 62 at the rear of the trailer 63 which is detachably coupled to a tractor 64 in a conventional manner. The frame or tower 60 is shown in the drawing in phantom lines in the laid-down position for transport, and in solid lines in the erect position at the well site. An A-frame or gin pole arrangement 65 also is pivoted to the base structure 62 at 66, and can be raised from a transport position to an erect position where it is locked by pins 67. A suitable winch 68 is provided with a pair of wire ropes 69, 70 (FIG. 6) that extend past sheaves 71, 72 to sheave assemblies 73, 74 that are rotatably fixed to an upper portion of the frame 60. From the sheave assemblies 73, 74 to ropes extend around sheave assemblies 75, 76 on the opposite side of the frame 60, and back to the first-mentioned sheave assemblies where the outer end of each rope is anchored. In order to erect the raising unit 14, the A-frame 65 is first erected and pinned as shown, and then the winch 68 is operated to pull in the wire ropes 69, 70 to cause the frame to be righted as shown. In the erect position, hydraulically operable locks of the type shown in FIG. 7 are activated to securely lock the frame 60 to the drilling unit mast 33. The raising unit 15 on the opposite or off-driller's side is erected and locked to the unit 33 in the same manner, whereupon the base structures 62 are simultaneously lowered by means of a suitable hydraulic suspension (not shown) until the structures 62 rest on the ground at grade level to provide an integrated drilling base. The trailers 63 can now be disconnected from the bases 62 and pulled away by the tractors 64 to a staging area, leaving the raising units 14 and 15 clear to receive the pipe storage units 16 and 17.

Referring to FIG. 7, a suitable hydraulically operable interlocking mechanism is shown. The mechanism 110 includes upper and lower ears 111, 112 that are welded to a structural frame member 113 of a unit, the ears having aligned holes 114. A tongue 115 welded to the framed member 116 of an adjacent unit has a hole 117 that will align with the holes 114 when the tongue is engaged between the ears. In the engaged position, a hydraulic cylinder 118 that is rigidly mounted on the member 113 by a bracket 119 leads a piston rod 120 with a tapered upper outer surface 121 that is extended through the holes when hydraulic pressure is supplied to the cylinder from a remote control station. Of course the piston rod 120 can be withdrawn from the holes by applying pressure to the opposite side of the piston within the cylinder 118.

The pipe storage units 16 and 17 are shown somewhat schematically in FIG. 8 in their respective erect positions. Each unit comprises a generally rectangular lattice framework similar to that used in constructing the raising unit frames, with the outer side of the framework preferably being formed as the bed of the trailer having a tractor detachable connected thereto. A transverse platform 80 mounted near the lower end of the frame 81 carries front and rear rows of powered sprockets 82, 83 around which is passed an endless chain 84 as shown. A series of cups 85 (FIG. 9) are fixed to the chain 84 at spaced points thereon to provide receptacles for the respective lower ends of a plurality of stands of pipe joints 86. Although only one such stand is shown in FIG. 8, it will be recognized that, for example, each unit may store a total of 100 stands of doubles, each stand being a 60 foot length of 5" diameter pipe.

An upper platform 87 has front and rear members 88, 89 that mount interleaved groups of guide rods 90, 91, with the outer ends of each group terminating short of the opposite side member to provide a plurality of parallel trackways 92 that are joined at their opposite ends to the next adjacent trackway. The trackways 92 function to guide the upper ends of the respective pipe stands as they are fed by the conveyor chain 84 toward a door 93 in the inner side member 94 of the platform 87. The upper and lower manipulator arms 47, 48 of the automatic pipe handling system 46 are pivoted jointly outward to the positions shown in phantom lines in FIG. 8, where gripping assemblies 96, 97 grasp a pipe stand, lift it out of the cup 85, and then swing it out the door 93 into a position of vertical alignment with output of the drive unit 36, and the axis of the power tongs 37. The tongs 37 then function to make up the pin on the lower end of the stand 86 with the box at the upper end of the previous stand which extends into the well bore. The predetermined sequence of rotational and vertical movements of the arms 47 and 48 necessary to move each stand of pipe, as described, are controlled by drive boxes 99 and 100 located at the respective upper and lower ends of the shaft 101 on which the arms 47 and 48 are mounted. The door 93 normally is closed by a gate (not shown) that is remotely and automatically opened and closed, the gate being in the form of a pin or piston rod extending from a hydraulic cylinder, similar to the element 120 in FIG. 7. Thus a continuous supply of pipe is automatically provided as needed during the drilling or casing of the well. Of course the reverse operating sequence is initiated when the drill pipe is being tripped out of the well.

As previously mentioned, the pipe storage units 16 and 17 are trailer-mounted so that each unit can be backed up to a base member 62 of a respective raising unit 14 or 15. When properly positioned, the storage units are hydraulically interlocked, and the cable guide arms 105, each of which includes a link 106, and arm member 107, and a hydraulic cylinder 108 having its opposite end connected respectively to the member 105 and the member 107, are pivoted downward and pinned to the pipe storage units, which at the point are lying in the horizontal position. Such downward pivoting leads the outer ends of the cables 69, 70, which are attached to the upper ends of the arms 105, down to points of connection with the frames of the storage units 16, 17, so that the same width units 68, 68' can be used to raise the frames to the erect position. The cylinders 108 are used to straighten the arms 105, 107 during downward pivotal movement so that they are fully extended. The storage units are then raised upward to the vertical, using the same wire rope and winch system that was used previously to erect the raising units. The tractors then can be driven away to the staging area.

By way of further detail of the functional components of each of the separate modules or units which together form an integrated drilling system, each of the electrical power supply units 18 and 19 may include a diesel generator set with a heat recovery system, rated at 850 KW @ 1200 RPM, 60 $H_z$, an S.C.R. unit, a service air compressor, a cold start compressor, hydraulic locks and plug-in boards. 0 course the size and rated output of the power supply can be tailored to the capacity and requirements of the rig.

The mud unit 28 preferably has three equal compartments, each housing a horizontal mud mixing impeller and all necessary piping and electrical equipment together with hydraulic locks and plug boards. The mud unit 21 has one mud mixing compartment that contains a centrifugal mixing hopper and an overflow feed to a suction tank, an auger feed for a bulk mud supply, and a water intake. This unit further includes two suction compartments with horizontal mixing impellers, plug boards, and all necessary piping and electrical connections. The reserve mud unit 27 also has three equal compartments, each housing a horizontal mixing impeller, and includes all necessary pipe and electrical connection, hydraulic locks and plug boards.

The water unit 25 should have about a 200 barrel capacity, and an appropriate centrifugal pump. The cement unit 24 would be complete with 1500 cubic feet capacity bulk cement hoppers. The fuel unit 26 also should have about a 200 barrel capacity, and be complete with filters and pumps.

OPERATION

Figure 10:
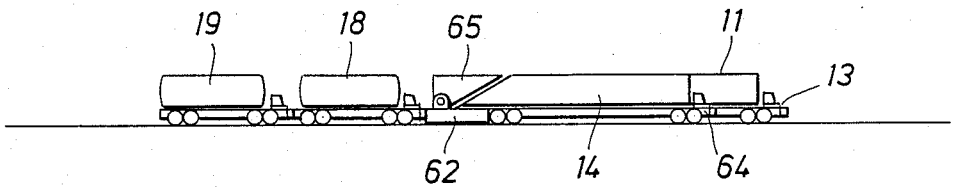
FIGS. 10–13 illustrate the sequence of erection and interconnection of the modules or units in providing an operational drilling system at the drill site.

The preferred method of practicing the present invention may be best illustrated with reference to FIGS. 10–13, which are schematic side elevation views to indicate the sequence of erecting and interconnecting the various units of the combination into a complete well drilling system. The drilling unit 11 is first driven into position aligning the centerline of the well with the centerline of the conductor pipe or surface casing, which has been previously installed. It should be noted that a cellar hole is not required. The raising units 14 and 15 are driven into position on the respective opposite sides of the drilling unit 11. Hydraulic locks as shown in FIG. 7 are activated to interlock the drilling and raising units to one another. The base structures 62 of the raising units are lowered simultaneously to grade by means of a hydraulic suspension, and outrigger supporting legs (not shown) may be lowered to provide additional stability. As shown in FIG. 10, the electrical power units 18 and 19 are driven consecutively into position at the rear of the raising unit 15, and are interlocked hydraulically as previously described.

Figure 11:
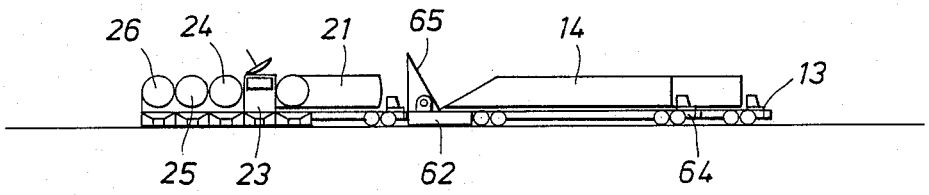

The mud units 20 and 28 then are driven consecutively into position at the rear of the drilling unit 11 and hydraulically interlocked, and the mud units 21 and 27 are likewise positioned and interlocked. Finally the mud pump unit 22, the command center unit 23, the cement unit 24, and the water and fuel units 25 and 26 are each driven into positions that are perpendicular to the mud units 21 and 27. Again all units are hydraulically interlocked to provide a structurally integrated system. At this time, all the aforementioned units can have all plugs engaged and secured, so that each unit can be activated and checked-out using the computer in the command center 23. As shown in FIG. 11, the A-frames or gin poles 65 now are raised to their erect position and pinned at 67.

Figure 12:
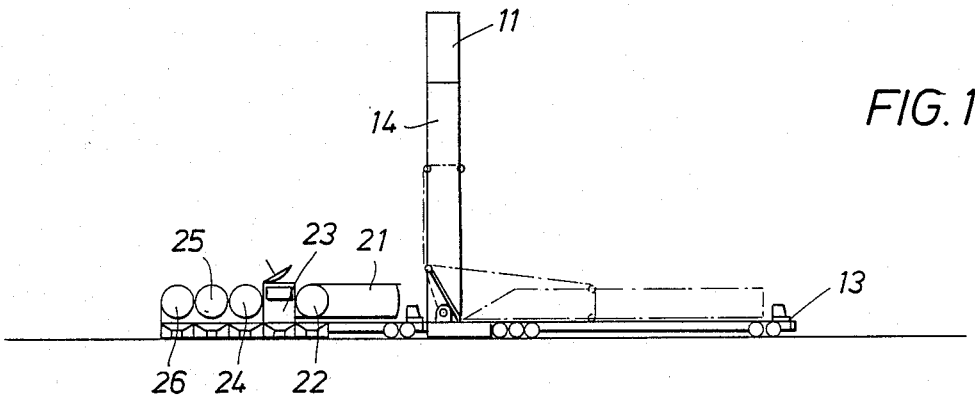

The raising units 14 and 15 then are erected simultaneously, using the self contained wire rope raising systems previously described. This step also results in raising the mast 33 of the drilling unit 11 to the vertical which is interlocked thereto, as shown in FIG. 12. Suitable hydraulic interlocks are activated to lock the units in the drilling position.

Now the forward trailer sections 63 of the raising units 14 and 15 can be disengaged and pulled by the tractors 64 to a staging area away from the drill site, leaving the raising units 14 and 15 clear to receive the pipe storage units.

Figure 13:
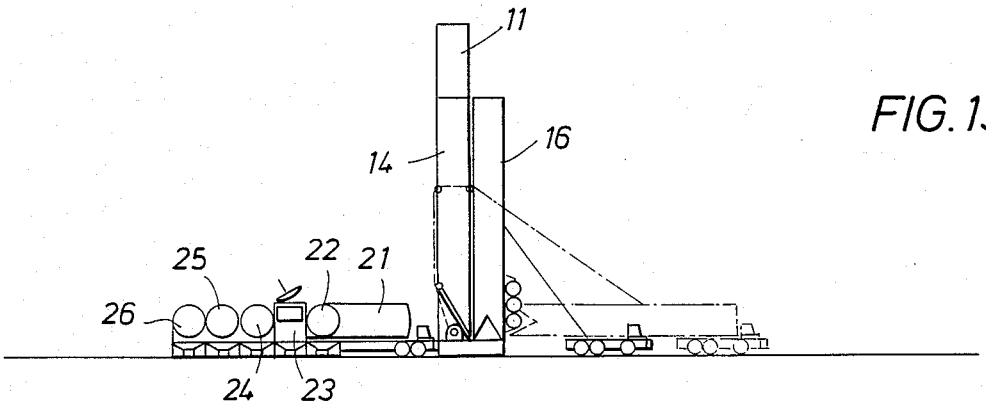

The pipe storage units 16 and 17 are backed into position as shown in FIG. 13, and are interlocked at their lower ends to the base structures 62. The raising arms 105 are pivoted or rotated downward to lead the outer ends of the cables 69, 70 to positions where they can be pinned to the horizontally disposed pipe units. Then the pipe storage units 16 and 17 are raised to vertical using the same wire rope winch system which was previously used to erect the raising units 14, 15 and the drilling unit 11. During such raising, the arm assemblers 105 are permitted to fold back to their original configurations. The complete drilling system is now operational and ready to begin drilling operations.

To drill a borehole, a bit joint, selected from the bit and tool container, is grasped by the lower pipe handling arm 48, and moved into position at the automatic power tong assembly 37, which holds the joint in place while the lower arm is retracted. The top drive unit 36 is lowered and connected to the bit joint, which then is lowered to the correct position to enable additional drill pipe to be added, and the connection torqued. The top drive 36 is then raised to an upper position that will enable installation at a 60 foot stand of drill pipe.

The upper and lower pipe handling arms 47 and 48 are moved simultaneously to the pipe storage unit 16, and actuated so as to clamp onto a stand of drill pipe located at the door 93. The retaining pins (not shown) which normally close the door are retracted automatically when the handling arms 47, 48 are locked, to enable the stand to be raised out of engagement with the support cup on the conveyor chain, and removed from the unit. The handling arms 47, 48 swing the stand into alignment with the centerline of the borehole, and then lower the same to enable the threaded connection to be made up by the power tongs with the bit joint therebelow.

The top drive assembly 36 then is slowly lowered until the bit tags bottom. While the drill string is being lowered, the conveyor chain 54 moves the next pipe stand into position behind the retaining pins that temporarily close the gate 93. After tagging the hole bottom, the bit is raised one foot or so, and the mud system, which has been mixing the mud, begins pumping the mud down the drill string into the hole. After mud circulation is established, the top drive assembly 37 is activated to rotate the drill string while lowering it at a predetermined rate. Weight-on-bit is applied or controlled by means of a tensioning device. The weight-on-bit, RPM, and rate of penetration are monitored by the computer in the command unit 23.

As additional stands of drill pipe are required, mud circulation is temporarily stopped as the drill string is raised until the pipe connection is positioned at the power tong assembly 37. The assembly is operated to unthread the joint connection, and the top drive 36 is raised to its upper position within the mast 33. The foregoing process is repeated until it becomes necessary to change the bit, log the wellbore, or set casing.

When it is desired to trip the pipe out of the hole, the string is raised and positioned to enable removal of a sixty foot "stand" of drill pipe. The power tong assembly 37 acts to unthread the connection, and then the stand is elevated to a position where it can be grasped by the handling arms 47 and 48. After the arms have grasped the stand, the top drive 36 is released. The handling arms 47, 48 return the stand to the pipe storage unit 36, and place it inside the gate 93. Then the retaining pins are closed, and the handling arms 47, 48 are rotated into alignment with the wellbore axis to receive the next stand of pipe. The conveyor chain 84 functions to move the pipe stand previously positioned thereon back into the pipe unit 16, leaving an open slot or space for the next stand. This process is repeated until all the drill pipe has been removed from the well, and the bit has been removed and repositioned in its container.

To log the wellbore, a suitable logging tool is removed from its container, and moved into alignment over the well by the lower handling arm 48. The tool is run into the well on electric wireline, and logging data is fed directly to the computer as the tool is withdrawn from the well.

In order to set casing, the pipe storage units 16 and 17 are lowered, and casing storage units are erected in their place. The casing string is made-up and run into the wellbore in the same manner as the drill string.

To cement the casing in place, the cement unit 24 produces slurry and pumps it down the casing until the annulus outside the casing is filled.

In order to disassemble the well drilling system and load out the components, the pipe storage units 16 and 17 are first lowered and removed by their tractors. The raising unit transports are backed into position and interlocked with the raising units 14 and 15. Both of the raising units, and the drilling unit 11, are lowered to horizontal simultaneously, and all interlocking devices, electrical connection and other systems are disconnected. With these three units completely separated, they are driven away from the well site.

The electrical power supply units 18 and 19 are disconnected and driven away, and the mud pump unit 22. The control, water, cement and fuel units 23–26 are removed, and the mud units 21, and 27 are driven from the well site in order. Finally the mud units 20 and 21 are backed out and driven away.

It now will be recognized that new and improved well drilling systems and methods have been disclosed. The system comprises a plurality of individual components that permit unitized erection procedures, simplified operations, and substantially reduced transportation requirements. The use of a computerized system provides advanced technology in the drilling area, which has traditionally lagged other industries. Rig personnel requirements also are reduced, resulting in overall drilling cost savings. The unit system as disclosed herein can be easily and quickly erected and put into operation. The unitized design reduces the total number of transported items or pieces of equipment to a minimum. The present invention is particularly applicable to Arctic environments because extensive winterizing procedures and personnel support systems are eliminated.

Although the present invention has been described in connection with a land-based well site, it will be recognized that it is readily adaptable to a self-contained, fully automated, unmanned, subsea unit which could be monitored via satellite, thus eliminating the expense of platforms, drill ships, or semi-submersible drilling rigs. Moreover, the system in its unitized form could be transported into space and assembled on another celestial body for the purpose of subsurface exploration.

Since certain changes or modifications may be made by those skilled in the art without departing from the inventive concepts involved, it is the aim of the appended claims to cover all such changes and modifications falling within the true spirit and scope of the present invention.

What is claimed is:

1. A modular unitized well drilling apparatus having a plurality of separately transportable and connectable units adapted for transport from one location to a second well sit location and comprising: a separately transportable drilling unit including an elongated mast adapted to be pivoted from a horizontal transport position to a vertical drilling position, said mast carrying a top drive unit for imparting rotary motion to a drill pipe; separately transportable first and second raising units adapted to be positioned on the respective opposite sides of said drilling unit and to be removably connected thereto, each of said raising units including a tower that is adapted to be pivoted from a horizontal to a vertical position; means for removably connecting the tower of each raising unit to said drilling unit at said well site location; base means on each of said raising units adapted to be lowered into engagement with the ground to provide a support; and means on said base means for simultaneously pivoting said towers of said raising units and said separate drilling unit after connection to said raising units to the vertical position from the horizontal position to permit rapid assembly of said well drilling apparatus at a well site.

2. The apparatus of claim 1 further including at least one pipe supply unit having an elongated frame adapted to store a plurality of stands of pipe; and means including said pivoting means for positioning said supply unit alongside said drilling unit so that pipe stored in said supply unit can be readily conveyed to a location within said mast.

3. The apparatus of claim 2 further including remotely operable handling means for removing successive stands of pipe from said supply unit and positioning them in alignment with the output of said top drive unit.

4. The apparatus of claim 3 further including remotely operable power tong means mounted near the lower end of said mast for making and breaking threaded connections in said pipe.

5. The apparatus of claim 4 further including individual tractor/trailer means for mounting each of said pipe supply units to allow rapid transport thereof to a drilling site.

6. The apparatus of claim 2 further including vehicle-mounted means for supplying electrical power to operate said drilling apparatus.

7. The apparatus of claim 6 further including vehicle-mounted means for mixing and supplying drilling mud to said drilling apparatus.

8. The apparatus of claim 1 further including vehicle-mounted computer means adapted to monitor and control various functions in connection with a well drilling operation.

9. The apparatus of claim 1 wherein said base means are releasably attached to a trailer means on which said raising units initially are mounting, whereby subsequent to upward pivoting of said towers said trailer means can be disconnected and driven away to a staging area.

10. The apparatus of claim 9 wherein said erecting means comprises frame means pivotally coupled to said base means and movable from a transport position to an upright position, and winch and cable means operable in combination with said frame means to cause erection of said towers and said mast.

11. The apparatus of claim 3 further including conveyor means on said storage unit for positioning successive stands of pipe in a location to be grasped by said handling means; and automatically operable gate means through which successive stands of pipe are removed by said handling means from said storage unit.

12. The apparatus of claim 11 wherein said conveyor means includes an endless chain having spaced supports adapted to receive the lower ends of said strands of pipe.

13. The apparatus of claim 12 wherein said conveyor means further includes front and rear rows of sprockets around which said chain passes to store said stands of pipe in a plurality of parallel rows.

14. The apparatus of claim 13 when said storage unit further includes guide means comprising a plurality of laterally spaced rows of tubular members providing guideways for the upper portions of said stands of pipe as they are moved by said conveyor means toward said gate means.

15. The apparatus of claim I wherein said elongated mast is mounted on a trailer means and is pivotally connected to the rear thereof; and further including a drawworks on said trailer for moving said top drive unit relatively along said mast.

16. The apparatus of claim 8 wherein said connecting means includes hydraulically operable means for interlocking the various units of said apparatus together to provide an integrated, unitized drilling system.

* * * * *